US006168232B1

(12) United States Patent
May

(10) Patent No.: US 6,168,232 B1
(45) Date of Patent: Jan. 2, 2001

(54) RAIL-SUPPORTED SEATING-TYPE MOTION FURNITURE HAVING STATIONARY-FOOTED ARM FRAME

(75) Inventor: Teddy J. May, Tupelo, MS (US)

(73) Assignee: Action Industries Inc., Tupelo, MS (US)

( * ) Notice: Under 35 U.S.C. 154(b), the term of this patent shall be extended for 0 days.

(21) Appl. No.: 09/287,350

(22) Filed: Apr. 7, 1999

Related U.S. Application Data

(60) Provisional application No. 60/080,889, filed on Apr. 7, 1998.

(51) Int. Cl.[7] ..... A47C 1/02
(52) U.S. Cl. ..... 297/84; 297/248
(58) Field of Search ..... 297/232, 248, 297/83, 84, 411.2, 411.44, 445.1; 248/915

(56) References Cited

U.S. PATENT DOCUMENTS 835,678 * 11/1906 Hammond ..... 248/915 X
863,874 * 8/1907 Rajner ..... 297/248 X
3,891,267 * 6/1975 Taylor ..... 297/68
4,740,031 * 4/1988 Rogers, Jr. ..... 297/232 X
5,217,276 * 6/1993 LaPointe et al. ..... 297/68 X
5,271,660 * 12/1993 LaPointe et al. ..... 297/68 X
5,740,564 * 4/1998 Hankins et al. ..... 297/232 X

FOREIGN PATENT DOCUMENTS

526484 * 8/1956 (BE) ..... 297/84
2293168 * 7/1976 (FR) ..... 297/248
222898 * 10 1924 (GB) ..... 297/84
381893 * 10/1932 (GB) ..... 297/232
235244 * 10 1986 (JP) ..... 297/248

* cited by examiner

*Primary Examiner*—Milton Nelson, Jr.
(74) *Attorney, Agent, or Firm*—Pillsbury Madison & Sutro

(57) ABSTRACT

A motion furniture article is disclosed that includes arm frames and false showy feet connected to a stationary base of the article, as opposed to a movable seat unit of the article. As a consequence, during movement of the movable seat of the article between fully erect and reclining positions, the false showy feet remain stationary.

6 Claims, 6 Drawing Sheets

RAIL-SUPPORTED SEATING-TYPE MOTION FURNITURE HAVING STATIONARY-FOOTED ARM FRAME

The benefit of priority is claimed of provisional application 60/080,889 filed in the U.S. Patent & Trademark Office on Apr. 7, 1998, the complete disclosure of which is incorporated herein by reference.

BACKGROUND OF THE INVENTION

1. Field of the Invention

This invention relates to non-swiveling, motion furniture that reclines from an erect position to one or more reclined positions, especially motion furniture on which false feet are provided.

2. Description of the Related Art

In conventional contemporary practice, the mechanism for a non-swiveling article of motion furniture (e.g., a reclining chair, seat or sofa) is arranged to have a base resting on and supported from the floor. Above the base, mechanical linkages bracing elements, mounting sites, activators, rocker locks and the like are provided, as is well known in the art, for operatively supporting a combined seat and arm frame, a back and optionally an ottoman (or leg rest, sometimes including both primary and secondary ottomans), all of which are upholstered.

In general, a one-seat furniture article is called a chair, a two-seat furniture article is called a love seat, and an article having three or more seats is called a sofa. Where one or more of the seats of an article are capable of being reclined, i.e., are reclinable, the condition or position in which the reclinable seat is fully upright is also known as a fully erect or completely closed position. Some reclinable seats are capable of reclining into only one locked position; however, other reclinable seats can be reclined into a plurality of locked positions. For example, where a seat is reclinable into two different reclining positions, the first stage of operation from the upright position results in the ottoman being fully extended, from a stored state, and the back tilted down at least somewhat, thereby achieving an intermediate (or TV) position. In some motion furniture, this first stage of operation is accompanied by a forward movement of virtually all of the movable parts of the furniture article relative to the stationary base. The purpose of this forward movement is to shift the center of gravity of the combined person and chair forwards, relative to where it would have been, as the person's own weight shifts rearwards relative to the movable part of the furniture article. As a consequence, the seating article will not tend to tip rearwards when occupant is no longer able to contact the floor with their feet. A further purpose for shifting the movable part of the chair forwards is that this shifting can reduce or eliminate the need for spacing the furniture article away from the wall of a room to accommodate the envelope of movement of the top of the back as reclining occurs.

In some motion furniture, the two positions described above complete the range of possible motion. In others, a third, fully reclined position is possible, in which the back tilts down further towards horizontal, and the movable part of the chair moves further forwards. In some constructions, the movable part of the chair is also elevated relative to the base in the fully reclined position. Closing involves a reversal of the motions described above.

Although it may not occur to a casual observer or even to a casual user, in most motion furniture, the furniture feet are not readily visible. Often the feet are provided as simple floor glides on the bottom of the base. The floor guides are typically spaced well within the upholstered perimeter of the furniture article for concealment purposes. However, the feet may become more noticeable as the furniture article is fully reclined.

While the floor glides and base are concealed in many conventional motion furniture, other conventional motion furniture have bases secured at an elevated location between the left and right footed arm frames. This class of furniture is known as the so-called high-leg design of motion chair.

The lack of decorative, showy feet for conventional, non-high-leg motion furniture, and, in particular for love seats and sofas having one or more motion seats, has inhibited designers and limited market penetration. There is believed to be a significant group of consumers who would like to enjoy having one or more articles of motion furniture in their living rooms and other less casual areas, but find that the substantially hidden foot style does not match the showy foot style of their other furniture or which otherwise suits their taste in furniture.

One convenient way of uniting the movement of separate seat units on a multiple-seat motion furniture article, used by Action Industries, Inc. in the United States, is shown in FIGS. 4 and 5. The article includes, as a substructure, a front rail 40 and a rear rail 42 extending lengthwise to the furniture article. (Colloquially, this substructure often is referred to as being a superstructure.) The frames of any static (non-motion) units of the article are fixed on these rails, and the base of each motion unit is mounted on both rails. The movable seat assemblies, such as assembly 44 illustrated in FIGS. 4 and 5, has cross-bars 46 and 48, which unite the front rail 40 and rear rail 42 to provide one article of seating-type motion furniture. An arm frame 50 is attached to the movable seat assembly 44, so that the arm frame 50 is moved as the assembly 44 is moved between its reclining and fully erect positions.

Conventionally, in these multiple-seat articles of seating-type motion furniture, substantially hidden feet 52 are provided on the undersides of the rails 40 and 42 for supporting the article on the floor.

There are a few known examples of conventional motion furniture provided with showy false feet, i.e., feet which are located under the arm frames where one would expect to see feet, but which feet do not actually touch, or only barely touch the floor. Showy feet under the arm frames, such as arm frame 50 shown in FIGS. 4 and 5, are false feet, which move with the respective combined seat and arm frame and do not actually supportingly engage against the floor. However, due to the attachment of the showy false feet to the bottom of arm frame 50, showy false feet shift forward and are elevated as the combined seat assembly 44 and arm frame 50 moves as the unit between reclined and erect positions. In a typical article of this latter type, the false showy feet move about 15–45 cm forwards and backwards as well as vertically, with some tilting, as the motion unit is (or motion units are) operated. To some, the movement of the false feet is odd and undesirable, since the false feet are suppose to give the appearance of stationary, supporting structures.

SUMMARY OF THE INVENTION

It is, therefore, an object of this invention to overcome the above-discussed drawbacks associated with motion furniture by providing a non-high-leg motion furniture article, and more particularly a multi-seat article, having stationary false showy feet that remain stationary during movement of the motion furniture from its erect to reclining positions.

In accordance with an embodiment of this invention, the motion furniture article includes a base structure supportable against a floor surface. The base structure includes at least front and rear rails extending lengthwise to the article. The article further comprises one or more movable seat units supported on the rails of the base and movable between a fully erect position and one or more reclining positions. Optionally, one or more of the seat units can also be supported on the base in a stationary manner, so long as at least one of the seat units is movable into a reclining position. The article also comprises first and second arm frames with false showy feet connected thereto. The first and second arm frames are respectively connected to opposite end portions of the front and rear rails, rather than to the movable seat unit. As a consequence, the arm frames and false showy feet connected to the arm frames remain stationary during movement of the movable seat units between their fully erect and reclining positions.

This invention may be applied to chairs, love seats, or sofas.

These and other objects, features, and advantages of the present invention will become apparent from the following detailed description of the invention when taken in conjunction with the accompanying drawings which illustrate, by way of example, the principles of this invention.

BRIEF DESCRIPTION OF THE DRAWINGS

The accompanying drawings are presented for the purpose of elucidating the principles of this invention. In the drawings.

DETAILED DESCRIPTION OF THE INVENTION

Figure 1:
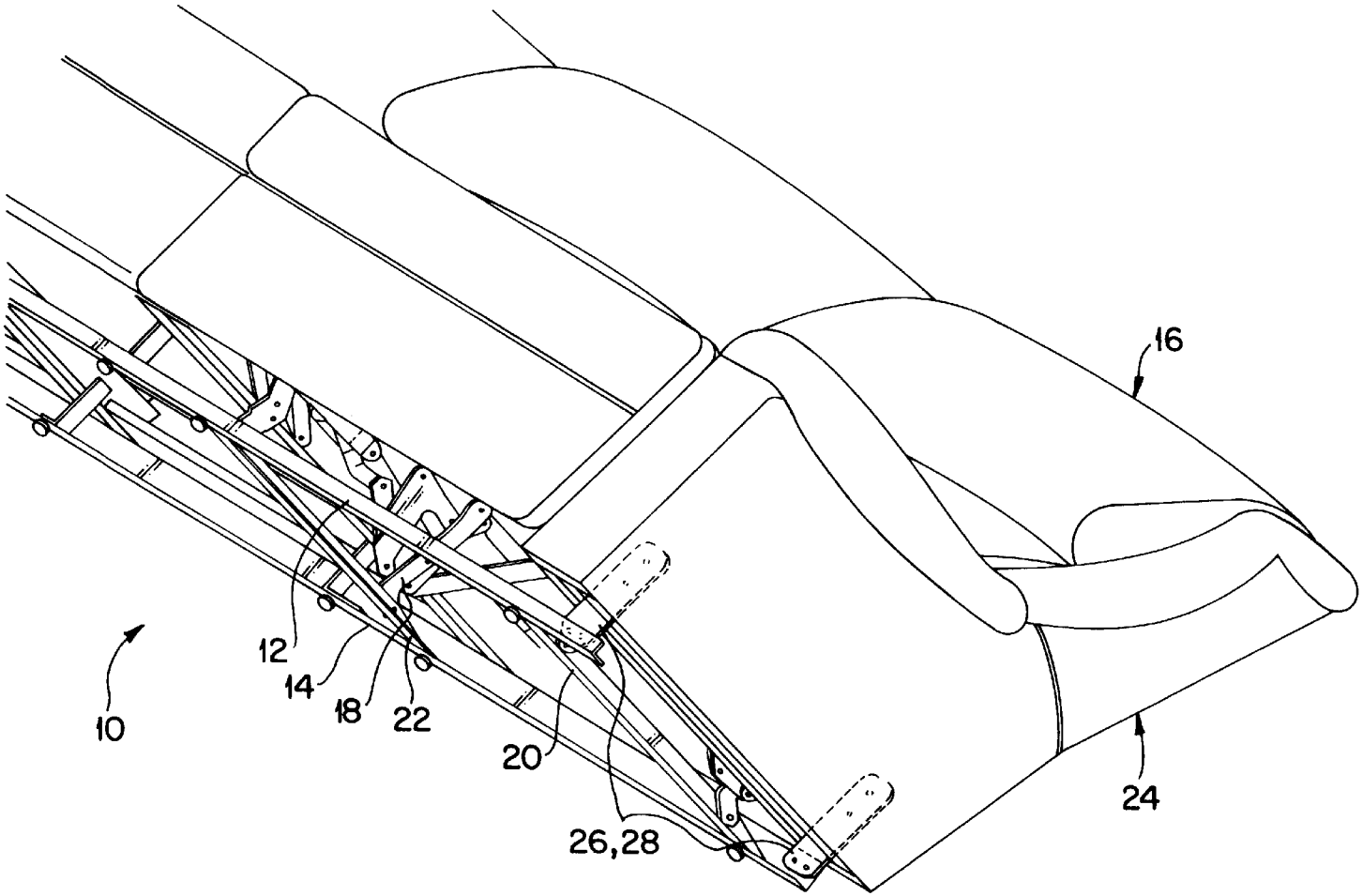
FIG. 1 is a schematic of a perspective view of a three-seat article of motion furniture embodying principles of the present invention.
Figure 2:
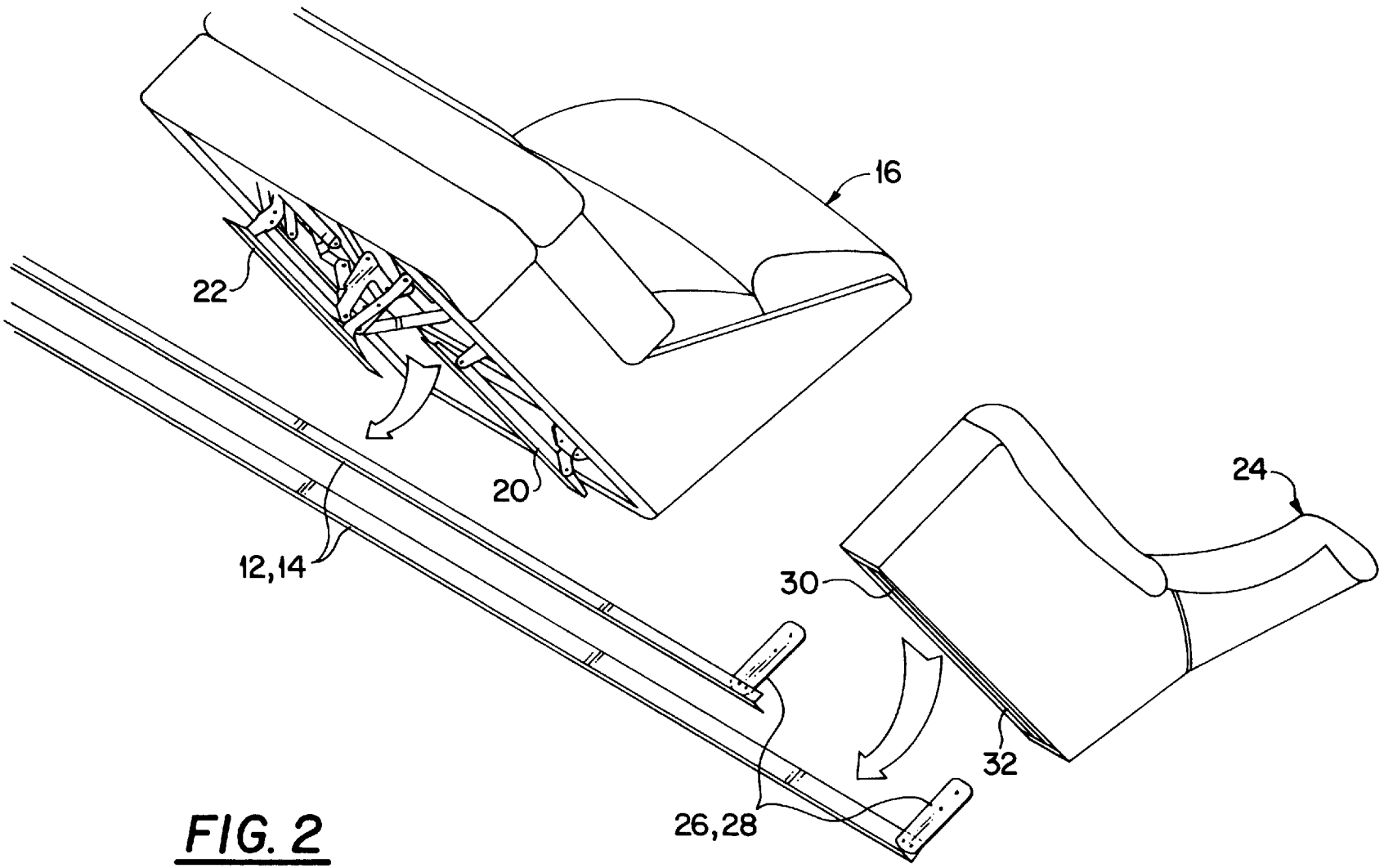
FIG. 2 is a schematic of an exploded perspective view of the three-seat article of motion furniture shown in FIG. 1.
Figure 3:
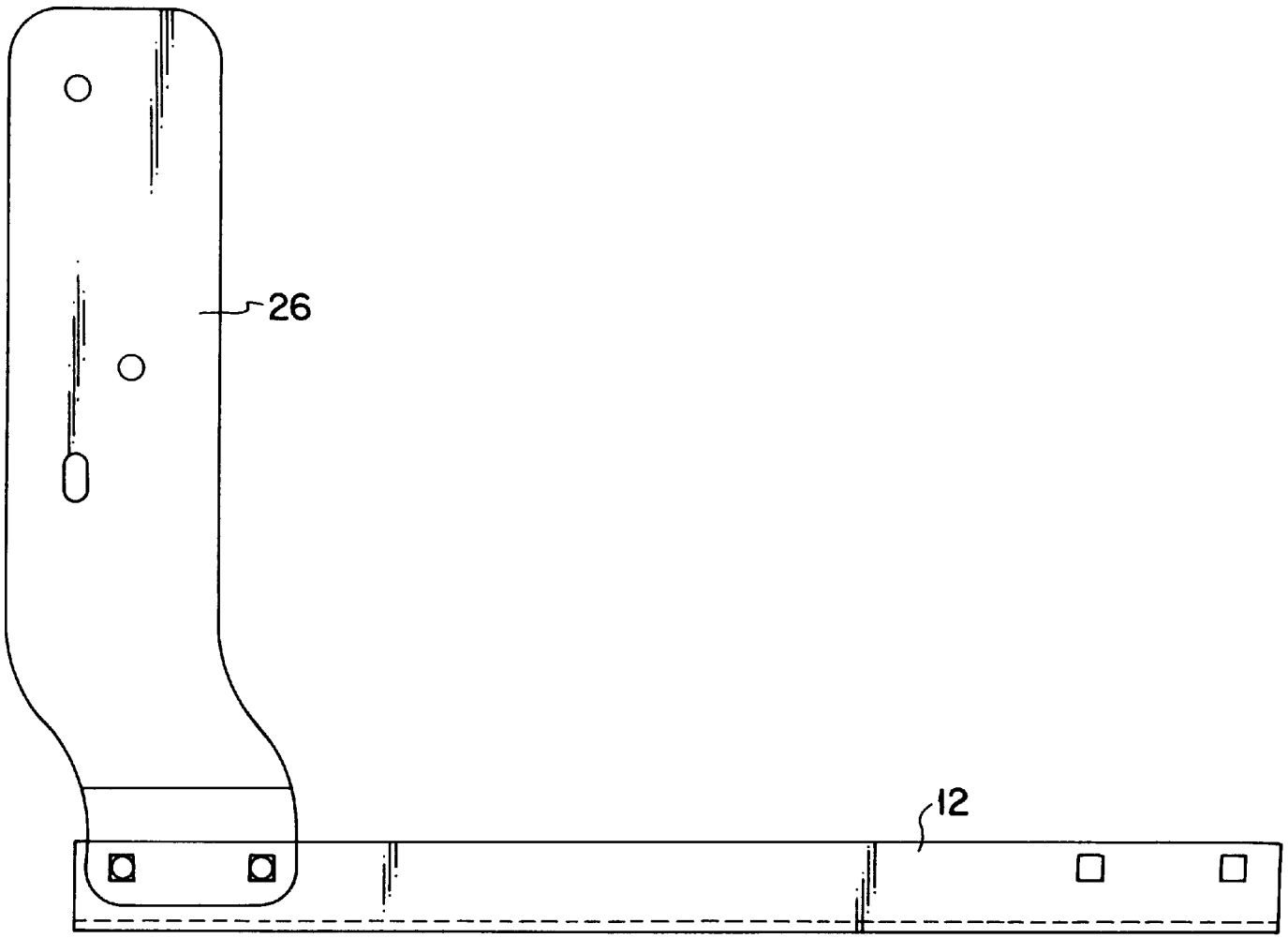
FIG. 3 is a schematic of an elevational view of a rail extension and arm-mounting bracket of the three-seat article of motion furniture shown in FIGS. 1 and 2.
Figure 4:
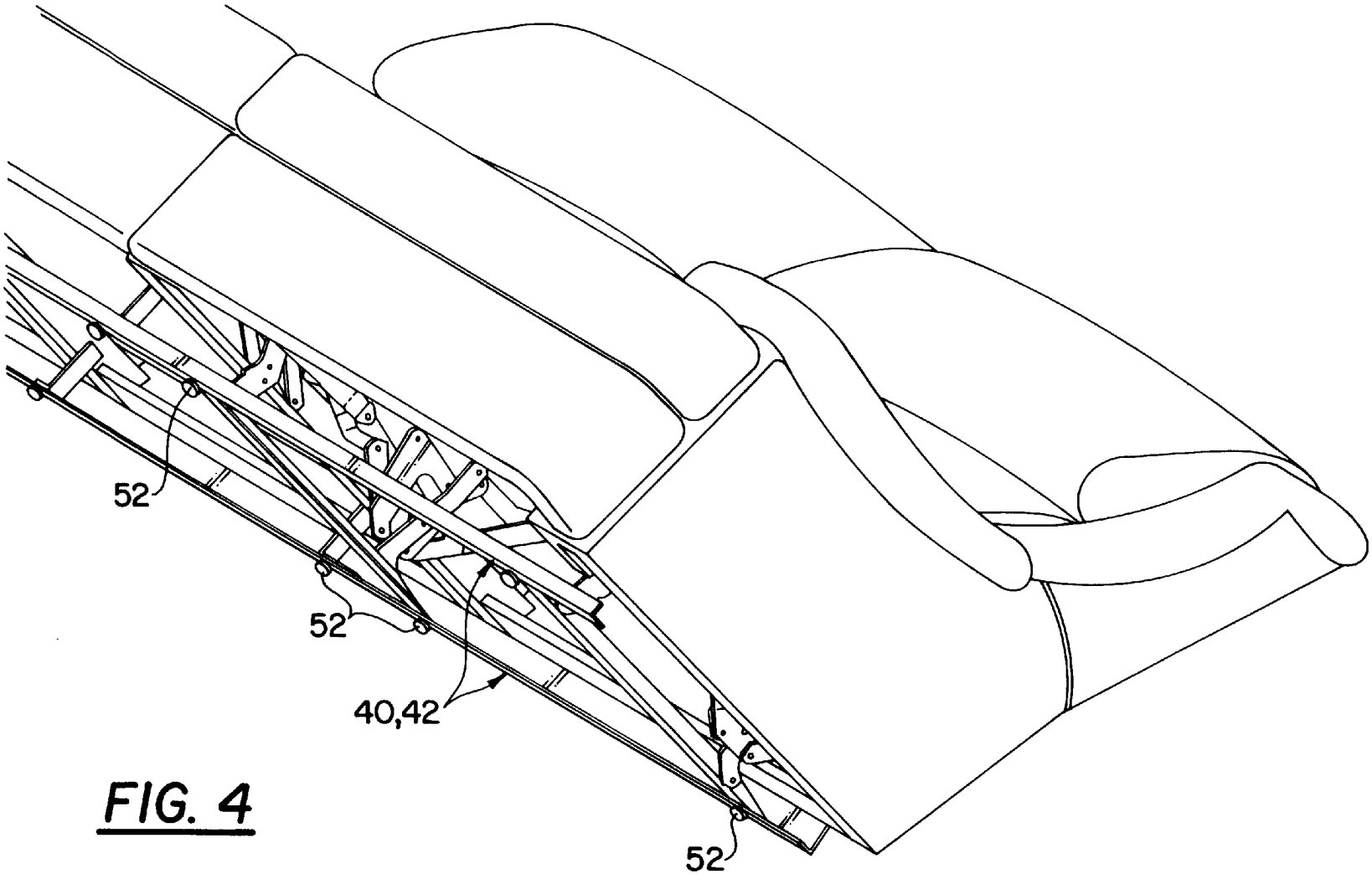
FIG. 4 is a schematic of a perspective view from the bottom, front end of a conventional multiple-unit seating-type article of motion furniture.
Figure 5:
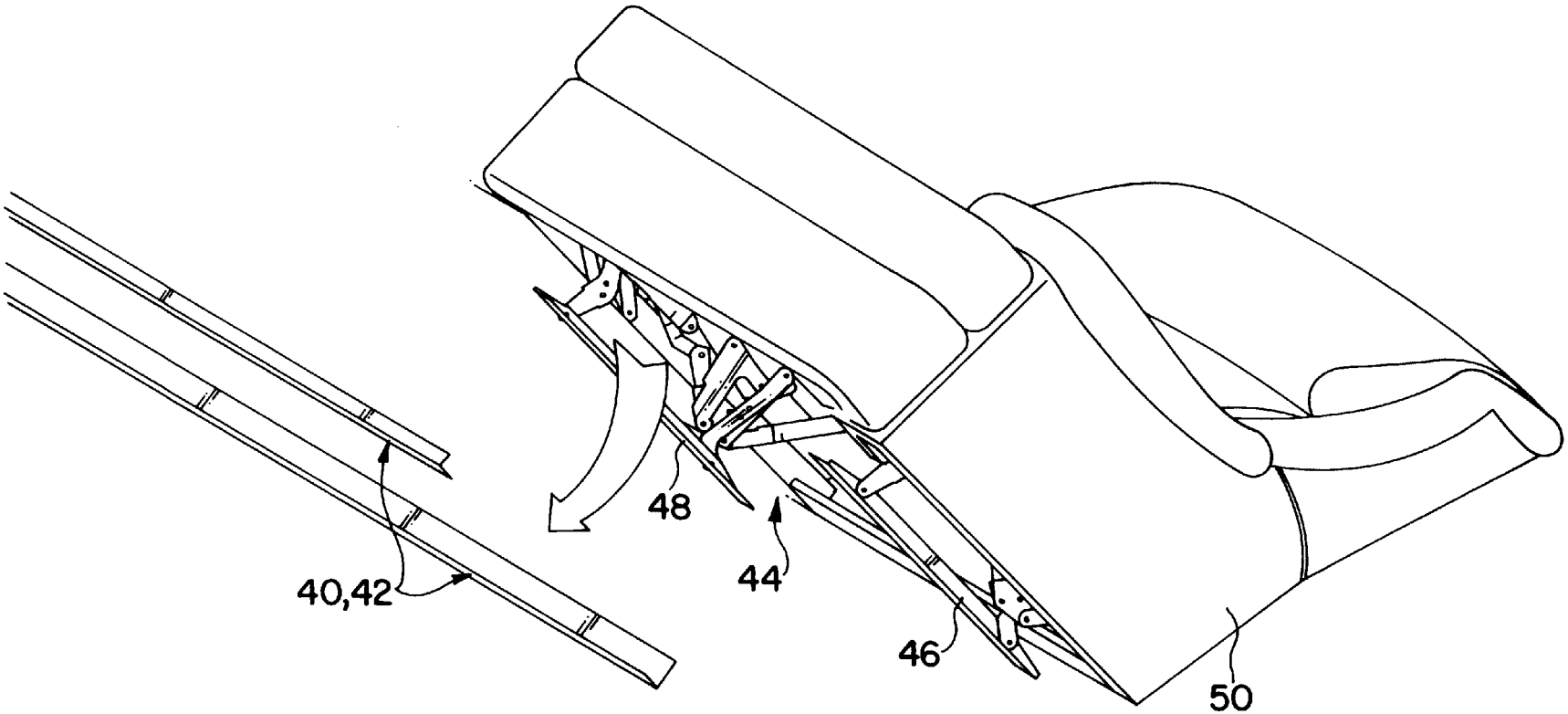
FIG. 5 is schematic of an exploded perspective view, from the same direction as FIG. 4, showing a portion of the conventional article of FIG. 4.

A motion furniture article in accordance with an embodiment of this invention is shown in FIGS. 1–3 and generally designated by reference numeral 10 therein. The article 10 includes, as a base structure supportable against a floor surface, a front rail 12 and a rear rail 14. The front and rear rails 12 and 14 extend lengthwise to the article 10. FIG. 1 shows a single movable seat unit 16 with movable base subassembly 18. Because the movable base subassembly 18 is well known in the art, it is not discussed further herein, other than to mention that the subassembly 18 has cross bars 20 and 22 that extend widthwise relative to the article 10 and connect the front and rear rails 12 and 14. The subassembly 18 permits movement of the seat unit 16 between the fully erect position depicted in FIG. 1 and one or more reclining positions. The remaining seat units of the article may independently be movable or stationary, i.e., non-reclining.

The article 10 further comprises first and second arm frames, although only the first arm frame is shown in FIGS. 1 and 2 and is designated by reference numeral 24. Flat brackets 26 and 28 connect the first arm frame 24 to the ends of the front and rear rails 12 and 14, respectively. The attachment of the brackets 26 and 28 to the front rail 12 and rear rail 14, respectively, is shown in greater detail in FIG. 3. Any suitable conventional fastener, including screws or rivets, can be used.

Although not shown in the drawings, false showy feet are connected at the bottoms of the arm frames. Suitable positions to attach the false showy feet to the arm frame 24 are designated by arrows 30 and 32 in FIG. 2.

As shown in FIGS. 1 and 2 and discussed above, the brackets 26 and 28 connect the first arm frame 24 to the front and rear rails 12 and 14 of the base, respectively. That is, neither the arm frame 24 nor the false showy feet are connected to the movable seat unit 16 or its base subassembly 18. As a consequence, the arm frame 24 and associated false showy feet remain stationary during movement of the movable seat unit 16 between its fully erect and reclining positions. In this manner, the illusion of the false showy feet supporting the article 10 is not compromised during reclining of the seat unit 16.

Figure 7:
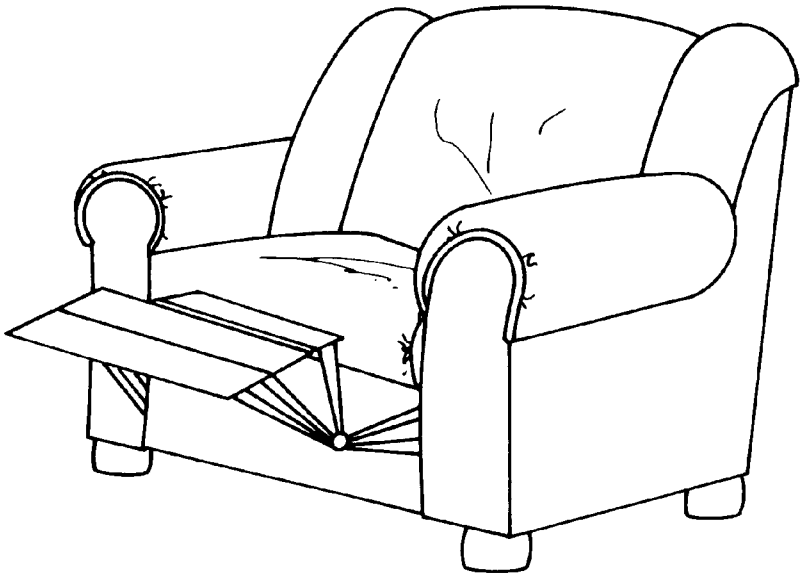
FIG. 7 is a schematic of a perspective view of a motion furniture chair embodying the principles of this invention.
Figure 6:
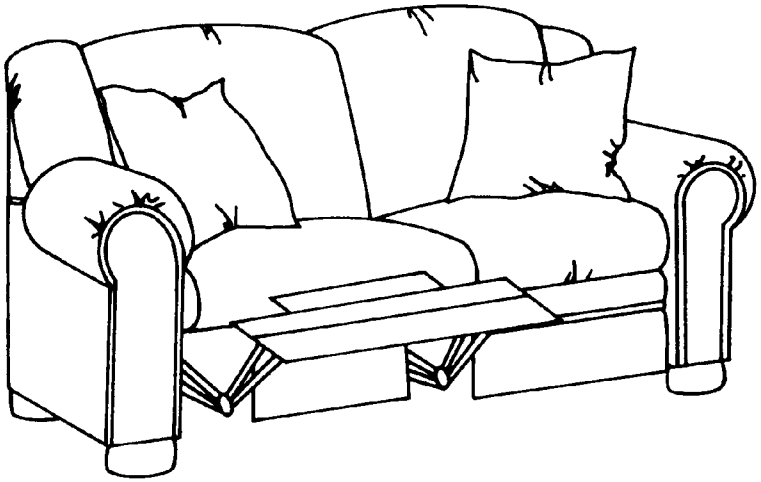
FIG. 6 is a schematic of a perspective view of a motion furniture love seat embodying the principles of this invention.

FIGS. 6 and 7 respectively illustrate a love seat and chair having false showy feet connected at the bottoms of the arm frames, so that the arm frames and associated showy feet remain stationary during movement of the movable seat unit between its fully erect and reclining positions.

The foregoing detailed description of the embodiments of the invention has been provided for the purposes of illustration and description. It is not intended to be exhaustive or to limit the invention to the precise embodiments disclosed. The embodiments were chosen and described to best explain the principles of the invention and its practical application, thereby enabling others skilled in the art to understand the invention. While the invention has been described in connection with what is presently considered to be the most practical and preferred embodiments, it is understood that the invention is not limited to the disclosed embodiments. To the contrary, this invention is intended to cover various modifications and equivalent arrangements included within the spirit and scope of the appended claims.

What is claimed is:

1. A motion furniture article comprising:

a stationary base supportable against a floor surface, said base comprising at least front and rear rails extending lengthwise to said article;

one or more movable seat units supported on said base, each of said movable seat units being movable between a fully erect position and one or more reclining positions;

first and second stationary arm frames engaged to opposite end portions of said base; and false showy feet respectively associated with said first stationary arm frame and said second stationary arm frame, wherein the engagement of said stationary arm frames with associated false showy feet to said stationary base permits said first and second stationary arm frames and said false showy feet to remain stationary as said one or more movable seat units are moved between the fully erect and reclining positions, and wherein said stationary base extends below said false showy feet for supporting said article against the floor while spacing said false showy feet away from the floor by a sufficient distance so that said false showy feet do not support said article against the floor.

2. The motion furniture article of claim 1, wherein said seat units each further comprises at least two cross bars extending widthwise to said article and connecting said front and rear rails.

3. The motion furniture article of claim 1, wherein said article is a chair.

4. The motion furniture article of claim 1, wherein said article is a love seat.

5. The motion furniture article of claim 1, wherein said article is a sofa.

6. The motion furniture article of claim 1, further comprising one or more stationary seat units supported on said base.

* * * * *